US008074580B2

(12) United States Patent
Chinuki

(10) Patent No.: US 8,074,580 B2
(45) Date of Patent: Dec. 13, 2011

(54) HOUSING APPARATUS AND HOUSING RACK

(75) Inventor: Motonari Chinuki, Chiba (JP)

(73) Assignee: The Bank of Tokyo-Mitsubishi UFJ, Ltd., Tokyo (JP)

( * ) Notice: Subject to any disclaimer, the term of this patent is extended or adjusted under 35 U.S.C. 154(b) by 813 days.

(21) Appl. No.: 11/939,002

(22) Filed: Nov. 13, 2007

(65) Prior Publication Data

US 2008/0238272 A1 Oct. 2, 2008

(51) Int. Cl.
*A47B 37/00* (2006.01)

(52) U.S. Cl. ..... 108/50.01; 108/60

(58) Field of Classification Search ..... 108/50.01, 108/50.02, 25, 26, 23, 60, 61, 59, 106, 110, 108/161, 152; 312/223.6, 223.3, 223.2; 211/41.1, 211/41.12, 134, 189, 180, 184
See application file for complete search history.

(56) References Cited

U.S. PATENT DOCUMENTS

| | | | | | |
|---|---|---|---|---|---|
| 1,374,633 | A | * | 4/1921 | Boyle | 108/106 |
| 4,646,655 | A | * | 3/1987 | Robolin | 108/92 |
| 4,836,114 | A | * | 6/1989 | Cohen et al. | 108/60 |
| 4,861,121 | A | * | 8/1989 | Gotz | 312/223.3 |
| 4,889,397 | A | * | 12/1989 | Ryan | 108/60 |
| 5,065,832 | A | * | 11/1991 | Mark | 108/50.02 |
| D325,137 | S | * | 4/1992 | Porter | D6/479 |
| 5,623,881 | A | * | 4/1997 | Huang | 108/50.01 |
| D424,827 | S | * | 5/2000 | Ko | D6/429 |
| 6,155,435 | A | * | 12/2000 | Malik | 108/66 |
| 6,298,794 | B1 | * | 10/2001 | Brown et al. | 108/50.01 |
| 6,722,673 | B1 | * | 4/2004 | Hamlin | 108/50.01 |
| 7,121,214 | B1 | * | 10/2006 | Toltzman et al. | 108/50.01 |
| 2005/0022699 | A1 | * | 2/2005 | Goza | 108/50.01 |
| 2008/0282940 | A1 | * | 11/2008 | Marion | 108/50.01 |
| 2008/0295743 | A1 | * | 12/2008 | Beam et al. | 108/50.02 |

FOREIGN PATENT DOCUMENTS

| | | |
|---|---|---|
| JP | 08-069342 | 3/1996 |
| JP | 2004-229051 | 8/2004 |
| JP | 2006-030913 | 2/2006 |

* cited by examiner

*Primary Examiner* — Jose V Chen
(74) *Attorney, Agent, or Firm* — Harness, Dickey & Pierce, PLC

(57) ABSTRACT

There is provided a housing apparatus in and out of which a keyboard and a mouse can be put and taken. The housing apparatus includes a keyboard housing section 11 that houses a keyboard in a vertical position, and a mouse housing section 18 on which a mouse can be placed, the mouse housing section 18 provided integrally with the keyboard housing section 11. The mouse housing section 18 allows mouses to be placed on both sides of the keyboard housing section 11. The keyboard housing section 11 is formed of a pair of supporting frames 12 that stand parallel to each other with a gap therebetween, and the mouse housing section 18 is formed of a flat plate 14 to which the lower ends of the supporting frames 12 are connected.

8 Claims, 5 Drawing Sheets

HOUSING APPARATUS AND HOUSING RACK

BACKGROUND OF THE INVENTION

1. Field of the Invention

The present invention is applied, for example, when panel display devices, such as liquid crystal monitors, are used to hold a TV conference, and relates to a housing apparatus and a housing rack in and out of which a keyboard and a mouse can be put and taken.

2. Description of the Related Art

In recent years, there have been provided various TV conference systems using networks, and they have been widely used, for example, when panel display devices, such as liquid crystal monitors, are used to hold a TV conference between locations remote from each other with a large number of attendees on both sides.

In such a TV conference system, for example, the attendees are seated in a circle, and display devices, such as liquid crystal displays, are placed in such a way that they face the attendees. Then, the attendees operate their keyboards, mouses and the like to participate in the TV conference.

In this case, by using a display device stand, such as that disclosed in Japanese Patent Laid-Open No. 2006-30913, and attaching a display device to the display device stand, the display device can be moved integrally with the display device stand and hence easily placed in a position where it faces each attendee.

Furthermore, by placing an individual table or the like for each attendee, housing a personal computer body in the table or the like, and placing a keyboard and a mouse on the table or the like, each attendee operates the keyboard and the mouse, thus allowing the TV conference to smoothly proceed.

With the individual table or the like placed for each attendee and the keyboard and the mouse placed on the table or the like as described above, when the attendee is involved in other tasks on the table or the like while participating in the TV conference, the keyboard and the mouse may disturb doing other jobs, thus preventing the smooth proceedings of the TV conference.

On the other hand, to address the above problem, by using a housing stand, such as that disclosed in Japanese Patent Laid-Open No. 8-69342, placing the housing stand on the table or the like, housing the keyboard and the mouse in the housing stand when they are not used, and taking out the keyboard and the mouse as required for use, the space on the table or the like can be used for other tasks.

SUMMARY OF THE INVENTION

However, the housing stand described above is designed in such a way that the keyboard is inserted from the user's side into the housing stand, requiring significant efforts to take out and put in the keyboard. Furthermore, the housing stand does not stably stand by itself, so that it cannot be placed alone on the table or the like but needs to be supported by a weight or the like.

The present invention has been made in view of the conventional problems described above and aims to provide a housing apparatus and a housing rack that not only is used to smoothly progress a TV conference but also stably stands by itself and hence can be placed alone on a table or the like. The housing apparatus and the housing rack also allow a keyboard and a mouse to be put in and taken out in a stable manner.

To solve the above problems, a housing apparatus according to the present invention includes a keyboard housing section that houses a keyboard in a vertical position and a mouse housing section on which a mouse can be placed, the mouse housing section provided integrally with the keyboard housing section.

According to the housing apparatus of the present invention, a keyboard can be housed in the keyboard housing section in a vertical position and a mouse can be placed on the mouse housing section.

Additionally, since the keyboard housing section and the mouse housing section are integrated, the keyboard and the mouse can be taken out and put in without these housing sections falling over, thus allowing the keyboard and the mouse to be stably taken out and put in.

Furthermore, since the keyboard and the mouse can be taken out for use as required, when the housing apparatus is placed on a table or the like, the keyboard and the mouse, when not used, can be housed in these housing sections, so that the space on the table or the like can be used for other tasks.

In the present invention, the mouse housing section may be configured so as to allow mouses to be placed on both sides of the keyboard housing section. According to the housing apparatus of the invention, mouses can be placed on both sides of the keyboard housing section, and the mouses can be taken out from both sides of the keyboard housing section for use as required.

In the present invention, the keyboard housing section may be formed of a pair of supporting frames that stand parallel to each other with a gap therebetween, and the mouse housing section may be formed of a flat plate to which the lower ends of the supporting frames are connected. According to the housing apparatus of the invention, since the pair of supporting frames that form the keyboard housing section perpendicularly stand on the flat plate that forms the mouse housing section, the mouse housing section and the keyboard housing section can be integrated and placed on a table or the like in a stable manner, thus allowing the keyboard and the mouse to be stably taken out and put in.

In the present invention, an antislip mat may be provided integrally with the upper side of the mouse housing section. According to the housing apparatus of the invention, the antislip mat can prevent the mouse from falling off the mouse housing section.

The present invention also provides a housing rack includes a rack body having a substantially triangular shape when viewed from above and the housing apparatus placed at each corner of the rack body. According to the housing rack of the invention, the keyboard and the mouse can be housed at each corner of the rack body having a substantially triangular shape when viewed from above, and can be taken out for use as required.

As described above, with the housing apparatus according to the present invention, the keyboard can be housed in the keyboard housing section in a vertical position and the mouse can be placed on the mouse housing section. Therefore, by housing the keyboard in the keyboard housing section and placing the mouse on the mouse housing section when the keyboard and the mouse are not used, and taking out the keyboard and the mouse for use as required, the space on the table or the like can be used for other tasks.

Since the keyboard housing section and the mouse housing section are integrated, they can be placed by themselves on the table or the like without the risk of falling over, and the keyboard and the mouse can be stably taken out and put in.

Furthermore, since the antislip mat is provided integrally with the upper side of the mouse housing section, the mouse, when housed, will not fall off the mouse housing section.

Moreover, by providing the housing apparatus at the corner of the rack body having a substantially triangular shape when viewed from above, the keyboard and the mouse can be housed at each of the corners and taken out for use as required.

DETAILED DESCRIPTION OF THE PREFERRED EMBODIMENTS

An embodiment of the present invention will be described below with reference to the drawings.

The housing apparatus 10 and the housing rack 1 shown in the present embodiment are applied to various TV conference systems using networks, for example. When panel display devices, such as liquid crystal monitors, are used to hold a TV conference between locations remote from each other with a large number of attendees on both sides, the housing apparatus 10 is attached for use, for example, to the housing rack 1 that houses a personal computer body 22 and the like.

Figure 4:
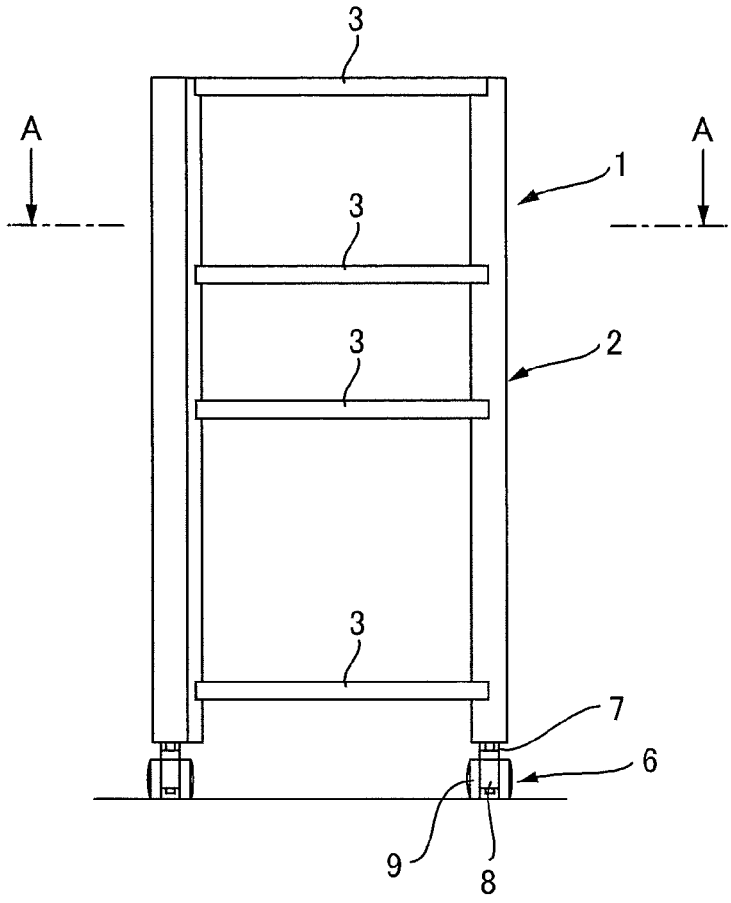
FIG. 4 is a front view of a housing rack.
Figure 5:
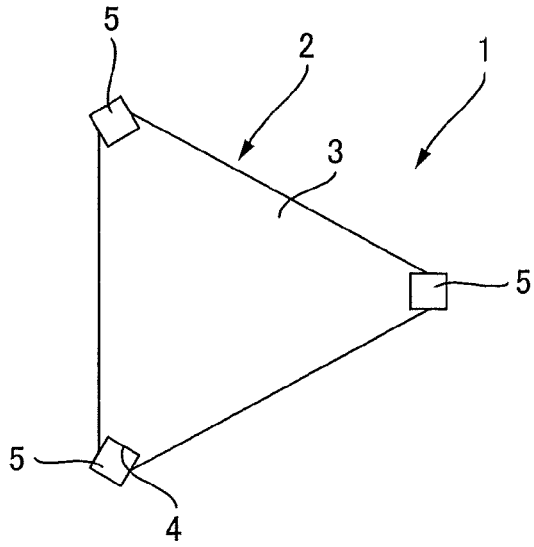
FIG. 5 is a plan view of FIG. 4.
Figure 8:
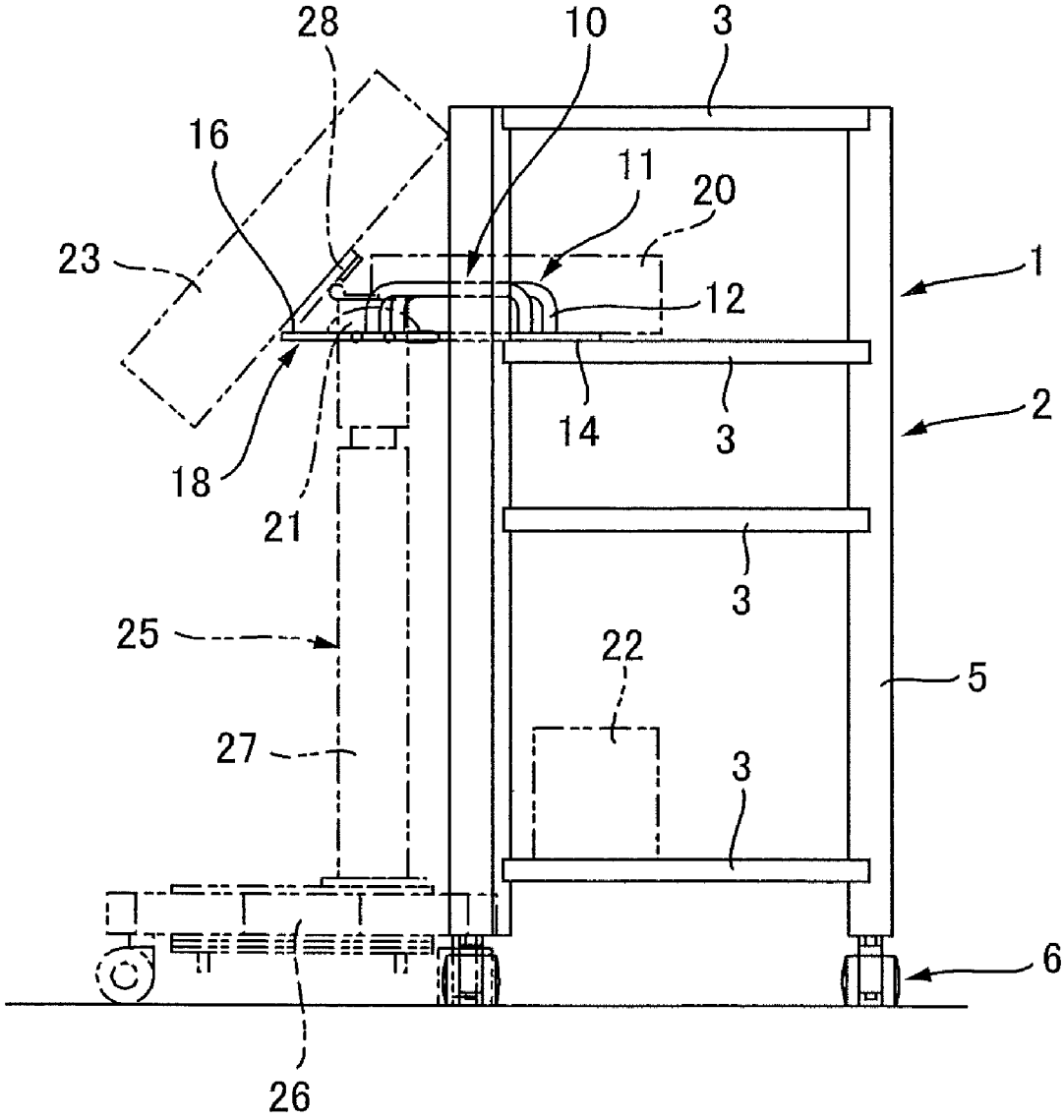
FIG. 8 is a partial front view of FIG. 7.

The housing rack 1 includes a rack body 2 having a substantially triangular shape when viewed from above, as shown in FIGS. 4 and 5. The rack body 2 includes a plurality of (four in the present embodiment) shelf plates 3 of the same size, each having a triangular shape when viewed from above, the shelf plates 3 disposed parallel to each other with a gap in the vertical direction, and three columns 5 perpendicularly provided along the corresponding corners of the four shelf plates 3. As shown in FIG. 8, the housing apparatus 10 according to the present invention is provided at each corner of the third shelf plate 3, as defined from the bottom shelf plate 3 of the housing rack 1.

The rack body 2 is formed by providing a cutout 4 at each corner of the shelf plates 3, fitting part of the column 5 in the cutouts 4 of the shelf plates 3, and integrally connecting the column 5 to the cutouts 4 of the shelf plates 3 using welding or the like, so that the rack body 2 has a substantially triangular shape when viewed from above.

The number of shelf plates 3 is not limited to four, but may be two, three, five or more. Alternatively, by connecting the columns 5 to the shelf plates 3 with screws, it is possible to adjust the positions where the shelf plates 3 are attached to the columns 5.

A caster 6 is attached to the lower end of each of the columns 5 of the rack body 2. These casters 6 support the rack body 2 and allow it to pivot and move in four directions, forward and rearward as well as rightward and leftward, on the floor. Therefore, the rack body 2 can be moved to a desired position with a personal computer body 22, a keyboard 20, a mouse 21 and the like housed therein.

The caster 6 is a commercially available caster and includes a base section 7 secured to the lower end of each of the columns 5 with screws (not shown), a support section 8 pivotably provided under the base section 7, a shaft (not shown), the central part of which is supported by the support section 8, and a wheel 9 rotatably supported by the shaft via bearings (not shown). When each of the wheels 9 rotates around the shaft and pivots by following the pivotal movement of the support section 8, the rack body 2 moves in four directions, forward and rearward as well as rightward and leftward, on the floor and pivots on the floor.

The caster 6 is not limited to the one configured as described above, but may be various other commercially available types. When the rack body 2 is not required to move, no caster 6 is necessary.

Figure 1:
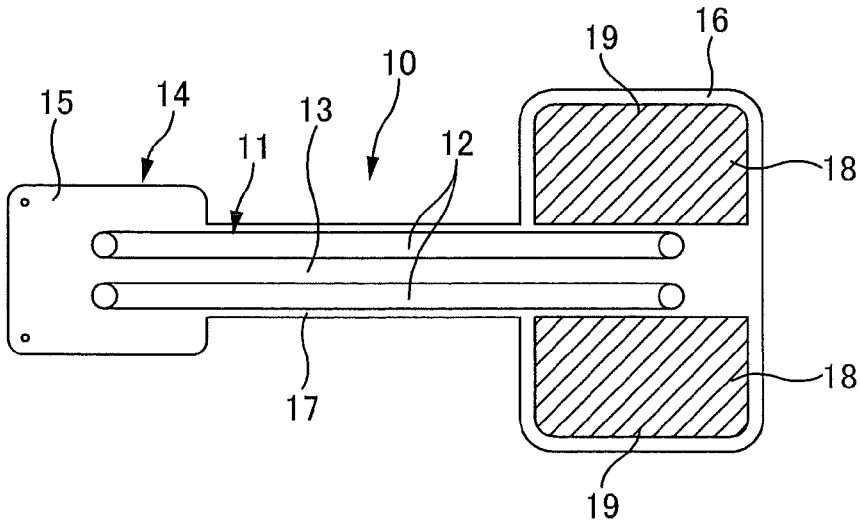
FIG. 1 is a plan view showing an embodiment of the housing apparatus according to the present invention.
Figure 2:
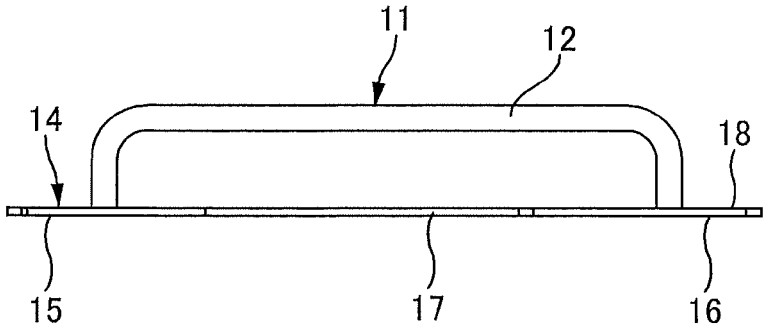
FIG. 2 is a front view of FIG. 1.
Figure 3:
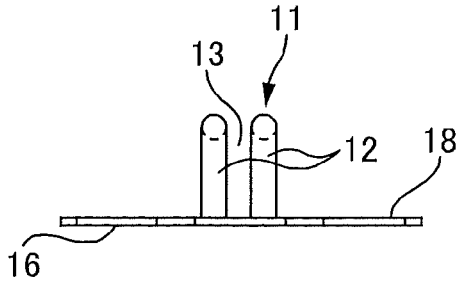
FIG. 3 is a right side view of FIG. 1.
Figure 6:
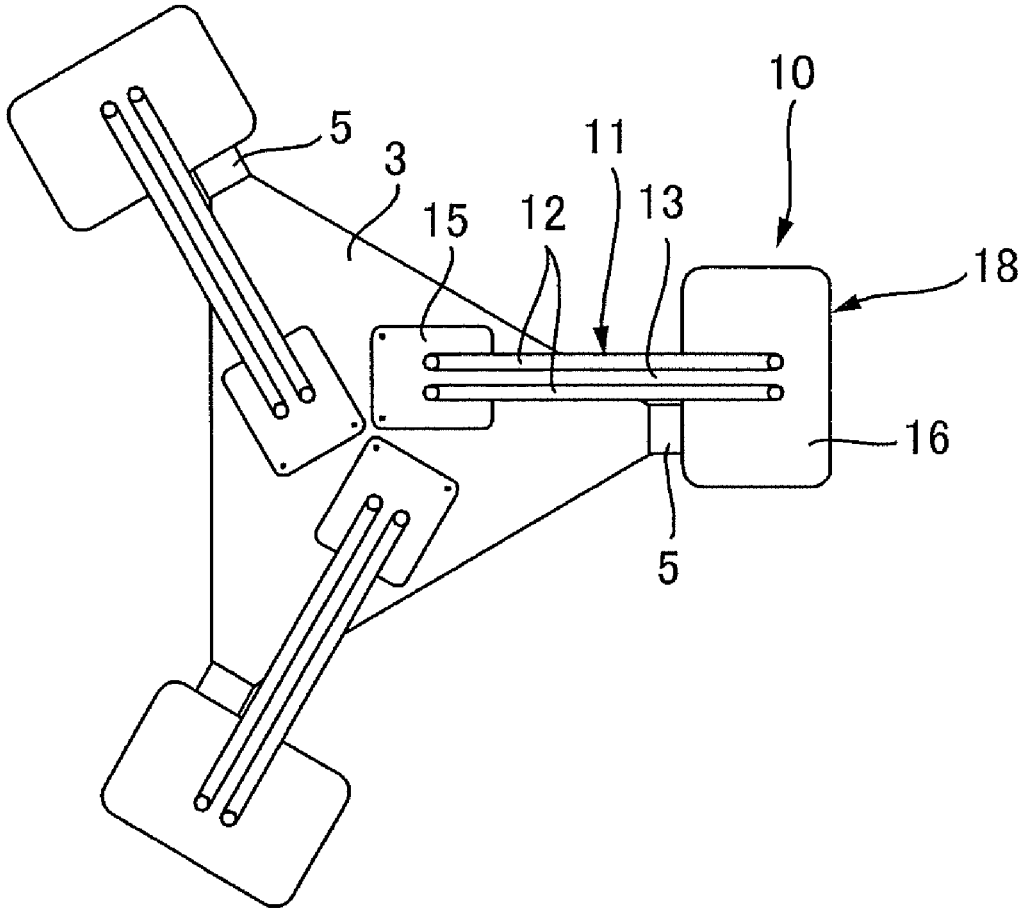
FIG. 6 explains the housing rack with housing apparatuses attached, viewed in the direction of the arrows A shown in FIG. 4.
Figure 7:
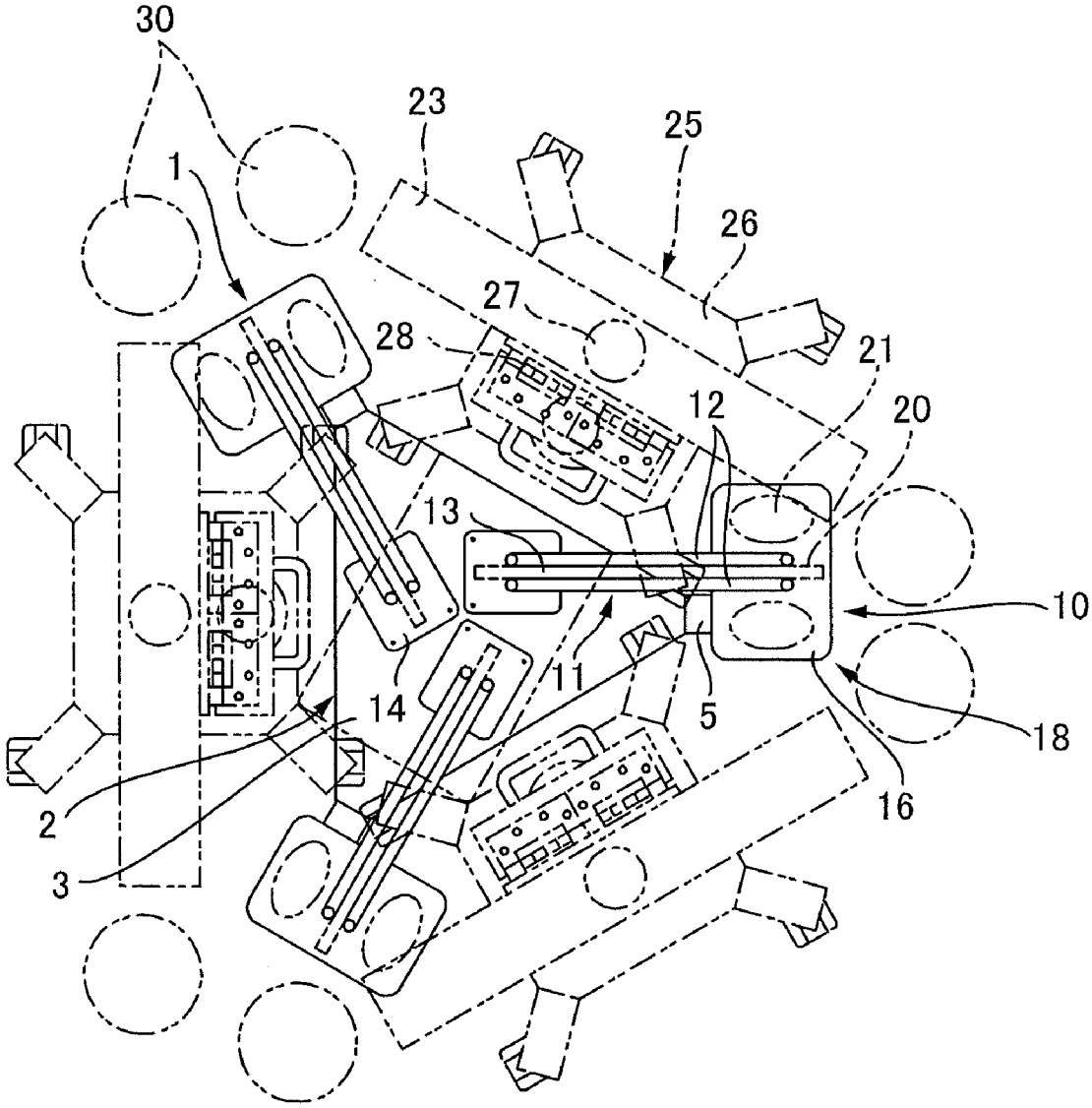
FIG. 7 is a plan view showing the positional relationship between housing apparatuses according to the present invention and display devices when the housing apparatuses are used to hold a TV conference.

The housing apparatus 10 includes a keyboard housing section 11 that houses the keyboard 20 and mouse housing sections 18, each housing the mouse 21, as shown in FIGS. 1 to 3. The housing apparatus 10 is integrally provided at each corner of a desired shelf plate 3 (the third shelf plate 3, as defined from the bottom shelf plate 3 in the present embodiment) in the rack body 2 of the housing rack 1 in such a way that the housing apparatuses 10 are disposed along radial lines from the center of that shelf plate 3, as shown in FIGS. 6 to 8.

The keyboard housing section 11 has a pair of supporting frames 12, each formed of a round pipe or a round bar with both ends bent into a substantially U-shaped form, disposed parallel to each other with a predetermined gap (a gap greater than the thickness of the keyboard 20) therebetween. Each of the thus disposed supporting frames 12 looks like an inverse-U shape when viewed sideways. Both ends of the pair of supporting frames 12 are connected integrally with the upper side of a flat plate 14, which will be described later, using welding or the like in such a way that the supporting frames 12 perpendicularly stand on the upper side of the flat plate 14. The keyboard 20 is housed in a vertical position in the gap 13 between the pair of supporting frames 12.

The flat plate 14 includes a rectangular plate-like attachment section 15, a rectangular plate-like mounting section 16 having a size greater than the attachment section 15, and a strip plate-like connection section 17 integrally connecting the attachment section 15 to the mounting section 16, so that the flat plate 14 has a substantially T-shaped form when viewed from above. The pair of supporting frames 12 that form the keyboard housing section 11 perpendicularly stand on the upper side of the flat plate 14 on both sides of the longitudinal center line thereof.

One end of each of the pair of supporting frames 12 is connected integrally with the central portion of the upper side of the attachment section 15 using welding or the like, while the other end is connected integrally with the central portion of the upper side of the mounting section 16 using welding or the like. The mouse housing sections 18 are provided on both sides of the pair of supporting frames 12 on the mounting section 16. The mouse 21 can be placed on each of the mouse housing section 18.

The mouse housing section 18 is horizontally disposed on the outer surface side of the column 5 (on the opposite side to the shelf plate 3) when the attachment section 15 is secured to the shelf plate 3. The mouse 21 can thus be placed on the mouse housing section 18 in a stable manner.

An antislip sheet-like mat 19 made of synthetic rubber or the like is provided integrally with the upper side of the mouse housing section 18 using an adhesive or the like. The antislip mat 19 prevents the mouse 21 from falling off the mouse housing section 18. A fence (not shown) for preventing the mouse 21 from falling may be provided along the periphery of the mouse housing section 18 in combination with the antislip mat 19.

The housing apparatus 10 is attached to each corner of the housing rack 1 by securing the attachment section 15 to each upper corner of the shelf plate 3 in the housing rack 1 with screws or the like. The position where the attachment section 15 of the housing apparatus 10 is attached to the shelf plate 3 is adjusted in such a way that approximately half the total length of the pair of supporting frames 12 that form the keyboard housing section 11 is disposed above the shelf plate 3, while the remaining approximately half length is disposed outside the shelf plate 3. By thus positioning the pair of supporting frames 12, approximately half the keyboard 20 housed in the gap 13 between the pair of supporting frames 12 is situated above the shelf plate 3, while the remaining approximately half is situated outside the shelf plate 3, allowing the keyboard 20 to be accessed from outside the housing rack 1 and easily put in and taken out of the keyboard housing section 11.

To hold a TV conference between attendees at locations remote from each other by using the housing rack 1 configured as described above according to the present embodiment, for example, as shown in FIGS. 7 and 8, a display device 23 is placed in the position corresponding to each side of the housing rack 1, and two or more attendees 30 (two in the present embodiment) are seated between adjacent display devices 23.

In this case, each of the display devices 23 is attached to the top of a display device stand 25 in advance, and configured in such a way that the vertical position of the display device 23 and the angle of the display screen can be adjusted. An example of a usable display device stand 25 includes a base 26 pivotable and movable in four directions, forward and rearward as well as rightward and leftward, on the floor, a vertically extendable column 27 provided on the upper side of the base 26 and standing perpendicular thereto, and angularly adjustable supporting means 28 provided at the top of the column 27. By attaching the display device 23 to the supporting means 28 of the display device stand 25 configured as described above, the vertical position of the display device 23 and the angle of the display screen can be adjusted.

It is noted that the display device stand 25 is not limited to the one configured as described above, but may be other various known display device stands.

Then, by seating two or more attendees 30 between adjacent display devices 23 as described above, the attendees 30 can participate in the TV conference while they look at the display screen of the adjacent display device 20 located either to the right or left. In this case, each attendee accesses the housing apparatus 10 between the display devices 23 and takes out and operates the keyboard 20 housed in the keyboard housing section 11 or the mouse 21 housed in the mouse housing section 18 as required, so that the attendee can manipulate the contents displayed on the display screen, allowing the TV conference to smoothly proceed.

In the housing apparatus 10 and the housing rack 1 configured as described above according to the present embodiment, the keyboard 20 is housed in a vertical position in the keyboard housing section 11 and the mouse 21 is housed in the mouse housing section 18 in such a way that the mouse 21 is placed thereon. Therefore, when the keyboard 20 and the mouse 21 are not used, they are housed in the housing sections 11 and 18, so that a working space for other tasks can be created on the table or the like, allowing the TV conference to smoothly proceed.

Furthermore since the mouse housing sections 18 are provided on both sides of the keyboard housing section 11, when a TV conference is held with attendees seated in a circle, each of the attendees can take the mouse 21 out of the mouse housing section 18 and put the mouse 21 in the mouse housing section 18 from both sides, allowing the TV conference to be active.

Although the above description has been made of the case where the housing apparatus 10 according to the present embodiment is attached to a corner of the housing rack 1, the housing apparatus 10 may be placed on a table or the like. Also in such a case, the same advantages are provided. When the housing apparatus 10 is placed on a table or the like, since the keyboard housing section 11 and the mouse housing section 18 are integrated, the keyboard 20 and the mouse 21 can be stably taken out and put in even when the integrated housing sections are placed alone on the table or the like.

What is claimed is:

1. A housing apparatus comprising:

a flat plate with a plan view of a substantially T-shape including an attachment section, a mounting section, and a strip plate-like connection section integrally connecting the attachment section to the mounting section, the attachment section being configured to be fastened to a separate support member so that the flat plate is disposed substantially horizontally; and a pair of supporting frames that stand parallel to each other with a gap therebetween, one end of each of the supporting frames being connected to the attachment section of the flat plate, the other end of each of the supporting frames being connected to the mounting section of the flat plate, wherein the flat plate and the pair of supporting frames constitute a keyboard housing section that houses a keyboard in a position substantially perpendicular to the flat plate, and the mounting section constitutes a mouse housing section on which a mouse can be placed.

2. The housing apparatus according to claim 1, wherein the attachment section and the mounting section have a rectangular plate-like structure respectively, the attachment section and the mounting section are provided to the connecting section at end portions thereof respectively, and the mounting section has a size greater than the attachment section.

3. The housing apparatus according to claim 1, wherein an antislip mat is provided integrally with the upper side of the mouse housing section.

4. The housing apparatus according to claim 1, wherein each of the supporting frames has a substantially U-shaped profile.

5. A housing rack comprising:

a rack body having a substantially triangular shape when viewed from above; and a shelf plate having a substantially triangular shape when viewed from above, the shelf plate being disposed substantially horizontally in the rack body; and a housing apparatus placed at each corner of the rack body, the housing apparatus including a flat plate with a plan view of a substantially T-shape including an attachment section, a mounting section, and a strip plate-like connection section integrally connecting the attachment section to the mounting section, the attachment section being fastened to the shelf plate so that the flat plate is disposed substantially horizontally; and a pair of supporting frames that stand parallel to each other with a gap therebetween, one end of each of the supporting frames being connected to the attachment section of the flat plate, the other end of the supporting frames being connected to the mounting section of the flat plate, wherein the flat plate and the pair of supporting frames constitute a keyboard housing section that houses a keyboard in a position substantially perpendicular to the flat plate, and the mounting section constitutes a mouse housing section on which a mouse can be placed.

6. The housing rack according to claim 5, wherein the mouse housing section is configured so as to allow mouses to be placed on both sides of the keyboard housing section, wherein the attachment section and the mounting section have a rectangular plate-like structure respectively, the attachment section and the mounting section are provided to the connecting section at end portions thereof respectively, and the mounting section has a size greater than the attachment section.

7. The housing rack according to claim 5, wherein an antislip mat is provided integrally with the upper side of the mouse housing section.

8. The housing apparatus according to claim 5, wherein each of the supporting frames has a substantially U-shaped profile.

* * * * *

UNITED STATES PATENT AND TRADEMARK OFFICE

CERTIFICATE OF CORRECTION

PATENT NO. : 8,074,580 B2
APPLICATION NO. : 11/939002
DATED : December 13, 2011
INVENTOR(S) : Chinuki It is certified that error appears in the above-identified patent and that said Letters Patent is hereby corrected as shown below:

Title Page, please add Item (30) Foreign Application Priority Data
March 27, 2007 (JP) .....2007-2052

Signed and Sealed this
Seventeenth Day of April, 2012

David J. Kappos

David J. Kappos
*Director of the United States Patent and Trademark Office*